US005575187A

United States Patent [19]

Dieterlen

[11] Patent Number: 5,575,187

[45] Date of Patent: Nov. 19, 1996

[54] VARIABLE COUNT DIRECT DEPOSIT KNIFE

[75] Inventor: Paul E. Dieterlen, Covington, Ky.

[73] Assignee: R. A. Jones & Co. Inc., Cresent Springs, Ky.

[21] Appl. No.: 338,840

[22] Filed: Nov. 14, 1994

[51] Int. Cl.[6] ..... B26D 1/67; B65H 29/32

[52] U.S. Cl. ..... 83/98; 83/152; 83/945; 53/562; 53/244; 53/251; 53/253; 137/625.21

[58] Field of Search ..... 83/100, 152, 733, 83/945, 946, 98; 53/451, 455, 562, 368, 370, 244, 250, 251; 493/371, 365, 367, 471, 194, 195, 196, 197; 414/737; 198/471.1, 803.5; 137/625.21

[56] References Cited

U.S. PATENT DOCUMENTS 3,597,898 8/1971 Cloud .
3,683,730 8/1972 Driessen ..... 83/152 X
3,822,008 7/1974 Benner, Jr. et al. .
3,961,697 6/1976 Hartman et al. .
4,872,382 10/1989 Benner, Jr. et al. .
5,220,993 6/1993 Scarpa et al. .
5,222,422 6/1993 Benner, Jr. et al. .

*Primary Examiner*—Rinaldi I. Rada
*Assistant Examiner*—Boyer Ashley
*Attorney, Agent, or Firm*—Wood, Herron & Evans, PLL

[57] ABSTRACT

A rotary knife apparatus for depositing filled pouches in preselected count stacks along a travelling product conveyor. The rotary knife apparatus includes a rotating disc valve intermediate negative and positive pressure sources on one side and a rotary knife hub on the other side. The rotating disc valve includes a plurality of arcuate slots and apertures which communicate with the negative and positive pressure sources and axial ports in the knife hub such that the knife hub holds and expels the filled pouches along defined segments of rotation of the knife hub. The rotating disc valve has a dynamically variable rotational speed relative to a rotational speed of the knife hub for changing a predetermined number of different angular drop-off points during a period of rotation of the knife hub to correspondingly change the preselected count of pouches in a stack.

15 Claims, 11 Drawing Sheets

9
9
40
50
52
56
58
60
62
64
66
68
70
72
74
76a-d
78
80
82
84
120
120a
120b
122
126
128
129
130
131
132
133
134
135
137
137a
138
139
140
142
144
146
148
150
152
154
156
158
160
162
164
166

VARIABLE COUNT DIRECT DEPOSIT KNIFE

BACKGROUND OF THE INVENTION

This invention relates to pouch machines and, more particularly, to an improved rotary knife apparatus used in connection with a pouch form, fill and seal machine capable of sequentially discharging pouches into pouch stacks along a product transfer conveyor and dynamically varying the pouch counts in the pouch stacks.

The present application is related to the following United States patent applications filed on even date herewith and entitled: "Convertible Pitch Knife Apparatus", by P. Dieterlen, Ser. No. 08/338,848 (attorney docket No. J&C-139); "Low Thermal Inertia Sealer", by M. Wildmoser, Ser. No. 08/338,870 (attorney docket No. J&C-140); "Convertible Pitch Pouch Machine", by F. Oliverio and B. Makutonin, Ser. No. 08/338,860 (attorney docket No. J&C-142); and "Tuck Roll With Improved Web Tension Control", by M. Wildmoser and Frank G. Oliverio, Ser. No. 08/338,839 (attorney docket No. J&C-147), each of which is expressly incorporated herein by reference.

In pouch machines of the known art, such as disclosed in U.S. Pat. No. 3,597,898 which is herewith incorporated herein by reference, a flat web of heat sealable material is continuously fed from upstream of the pouch machine to be longitudinally folded upon itself by a plow or similar device. In this form, the thus-folded web is fed about a sealer which contacts the folded web along vertical heated land areas to form transverse vertical seals and, thus, a series of open pouches along the web. In this way, the web of open pouches is passed around a filler wheel, filled with product and then sealed along the top edge of the web. The web of filled pouches then passes downstream to a motor-driven rotary knife apparatus which cuts the web along the transverse vertical seals into separate individual pouches and deposits them onto a transfer for subsequent cartoning or other secondary packaging.

In a typical cartoning operation of the known art, conveyors are used to transfer individually cut pouches away from the rotary knife to a cartoner machine. If the pouches are required to be stacked in preselected counts prior to being delivered to the cartoner, additional transfer conveyors and stacking apparatus must be operatively placed between the rotary knife and the cartoner machine to count, stack and move the pouches prior to cartoning.

It will be appreciated that it is desirable to reduce the number of pouch transfer operations occurring between the rotary knife and the cartoner machine. In one respect, reducing the number of pouch transfers makes the overall cartoning operation more reliable. In another, and equally important respect, floor space is saved and economies result by the reduction or elimination of conveyor and stacking apparatus required for the pouch transfer.

Prior to the present invention, it was known to control angular drop-off of pouches from a rotary knife to product transfer conveyors via vacuum and air ports cooperating within the rotary knife apparatus. One such apparatus, disclosed in Hartman et al., U.S. Pat. No. 3,961,697, provides a plurality of vacuum and air ports within the rotary knife apparatus for depositing individually cut pouches in side-by-side shingled fashion onto a moving product transfer conveyor. Further examples are disclosed in Benner, Jr. et al., U.S. Pat. No. 4,872,382, and Scarpa et al., U.S. Pat. No. 5,220,993, wherein a rotary wheel with radially extending suction cups first grasps and then expels cut pouches at predetermined angular drop-off points along the wheel and transversely across a transfer conveyor.

The known rotary knife and transfer apparatus generally have a series of radially extending and circumferentially spaced suction cups for grasping filled pouches cut from a web. As the suction cups move along a circular path about the rotary knife apparatus, vacuum is typically applied from a vacuum chamber to the suction cups along a segment of the circular path to hold the pouches. As the suction cups reach predetermined drop-off points, vacuum is withdrawn and air is blown through the suction cups to expel the pouches at the predetermined drop-off points.

In such rotary knife and transfer apparatus, axial bores are provided in the wheel to communicate with the suction cups. Arcuate negative and positive pressure slots are provided along a fixed shoe which cooperates with the wheel as the wheel rotates. The axial bores of the wheel rotate relative to the fixed arcuate slots in such a way that vacuum and air is alternately applied to the suction cups for holding and expelling the pouches as the axial bores overlie the negative and positive pressure slots in the fixed shoe, respectively.

It will be appreciated that while these advances have proven useful, the present rotary knife apparatus do not readily accommodate the formation of stacks of pouches directly from the knife, and particularly do not provide for forming such stacks in dynamically variable selective pouch counts, i.e., stacks with varied numbers of pouches. Furthermore, the known apparatus does not provide for quick and inexpensive changing of the number of drop-off points along the rotary knife wheel. Rather, the drop-off pattern of the known rotary knife apparatus is typically fixed and, thus, requires a changing of at least the fixed shoe to vary the number of drop-off points. In addition, the drop-off pattern of the known rotary knife apparatus cannot be easily changed to accommodate for different configurations of product transfer conveyors nor, as stated, for variable count stacks.

Accordingly, a primary objective of the present invention has been to provide a dynamically controllable rotary knife apparatus capable of sequentially discharging pouches into pouch stacks along a product transfer conveyor.

Another objective of the present invention has been to provide a rotary knife apparatus capable of dynamically varying pouch counts in the pouch stacks discharged along the product transfer conveyor.

It has been a further objective of the present invention to provide a rotary knife apparatus capable of dynamically changing drop-off patterns of pouches to accommodate for different configurations of product bucket conveyors beneath the apparatus.

SUMMARY OF THE INVENTION

To these ends, the present invention is directed to a motor driven rotary knife apparatus having a knife hub including a plurality of radially extending and circumferentially spaced knife blades and suction cups to respectively cut, hold and expel filled pouches from a web in preselected count stacks along a product conveyor. The product conveyor is disposed beneath the knife hub and travels either in the same or an opposite direction as the knife hub to receive the preselected count stacks of pouches.

The invention contemplates depositing pouches into pouch stacks along any product conveyor suitable for transferring the pouch stacks. In one embodiment, the product conveyor has a series of product transfer buckets which can be intermittently paused or slowed beneath the rotary knife to accommodate for rejected pouches or for varied pouch counts. The details of the product conveyor do not constitute a part of this invention. In particular, the present invention is directed to an apparatus and method for producing pouch stacks along the product conveyor by dynamically changing application of negative and positive pressure to the suction cups along various segments of rotation of the knife hub to define a plurality of pouch drop-off points. The angular spacing and number of pouch drop-off points is defined by a dynamic input to the rotary knife apparatus from a controller. In this way, pouches can be deposited in preselected count stacks along the product conveyor and the pouch count in the stacks can be dynamically changed by changing the controller input to the apparatus without changing parts on the rotary knife apparatus.

In accordance with the present invention, negative pressure is applied to the suction cups along at least one segment of rotation of the knife hub for holding the cut pouches and positive pressure is applied along another segment of rotation of the knife hub for expelling the pouches proximate predetermined angular drop-off points to achieve a preselected count stack of pouches along the product conveyor. The angular positions of the negative and positive segments are dynamically variable relative to a reference system considered fixed to the machine frame, and therefore also relative to the rotating knife hub. By changing the angular positions of the negative and positive pressure segments relative to the rotating knife hub, the angular spacing and number of pouch drop-off points, i.e., the pouch distribution pattern, can thus be changed to correspondingly change the count of pouches being deposited in stacks along the product conveyor.

The ability to control the pouch distribution pattern is accomplished by the provision of a varied number of valving rings and shoes moveable in relation to each other to provide the desired angular spacing and number of drop-off points. If the rotational speeds of the valving rings and shoes are dynamically varied in relation to each other, the angular spacing and number of pouch drop-off points can be correspondingly controlled to vary the pouch distribution pattern and thus, the count of pouch stacks along the product conveyor.

According to one embodiment, this is accomplished by the interposition of a rotary disc valve between negative and positive pressure sources on one side of the disc valve and axial ports in the knife hub and communicating with the suction cups on the other side of the disc valve. By dynamically varying the rotational speed of the rotating disc valve relative to that of the knife hub, the angular positions of the negative and positive pressure segments relative to the rotating knife hub axial ports are thereby changed to vary the angular spacing and number of pouch drop-off points occurring during a period of rotation of the knife hub.

In a preferred embodiment, the knife hub rotates at a higher rotational speed than the rotating disc valve, causing axial ports in the knife hub, which communicate with the suction cups, to sequentially overtake an aperture in the rotating disc valve which contains positive air pressure by virtue of its communication with a pressurized arcuate slot in a fixed shoe located on the opposite side of the rotating disc valve from the knife hub. As each axial port in the knife hub overtakes the same pressurized aperture in the rotating disc valve, a pouch formerly held to the suction cup by vacuum is propelled from the suction cup by a resulting puff of air and falls onto the moving product conveyor.

Due to the angular rotation of the disc valve between the times a first axial port in the knife hub overtakes the pressurized aperture and a second axial port overtakes the same pressurized aperture, the angular position of the second pouch discharged will be different from the first pouch discharged to match the moving product conveyor. In this way, a sequential discharge of pouches can be obtained in which the pouch distribution pattern will follow moving product conveyor, thereby resulting in a preselected count stack of pouches on the product conveyor. As a result of the rotation of the rotating disc valve relative to the fixed shoe containing the arcuate pressurized slot, a new aperture in the rotating disc valve will, in time, become pressurized, causing a new sequential drop pattern of pouches to be initiated, resulting in another preselected count stack of pouches being deposited on the product conveyor.

In accordance with the present invention, the angular difference between the sequential discharges of pouches and the number of pouches discharged in a preselected count stack are dependent on the rotational speed of the rotating disc valve relative to that of the knife hub, and can be controlled and varied by varying these relative rotational speeds. The number of pouches in each stack thus formed depends on the number of axial ports in the knife hub which overtake each pressurized aperture in the rotating disc valve before a new aperture in the rotating disc valve becomes pressurized. For example, if the rotating disc valve is moving relatively slowly compared to the knife hub, a large number of pouches will be deposited in each pouch stack. On the other hand, if the rotating disc valve is moving at a speed more nearly equal to that of the knife hub, each stack will contain only a few pouches.

Furthermore, by arranging the locations of the ports, apertures and slots in the valving rings and shoes of the rotary knife apparatus in various ways and allowing the relative rotational speeds of the rotating disc valve and knife hub to be controlled in a variable fashion, additional versatility in the control of the pouch distribution pattern can be obtained, for example, to allow pouches to be stacked in product transfer buckets which are unequally spaced along a product conveyor.

A further provision of the rotary knife apparatus is to maintain direct communication of a negative pressure source with each suction cup until just before the pouch being held by the suction cup is discharged as described above. This assures that the pouch is not discharged prematurely due to bleeding off of the vacuum holding the pouch to the suction cup, and also helps assure the most uniform pouch discharge patterns as a precise transition is always made from vacuum to air applied to the suction cups.

In order to allow communication of the negative pressure source with the suction cups to follow the dynamically varying pouch angular discharge positions, the rotating disc valve is provided with a series of arcuate slots in a one-to-one correspondence with the apertures described above. The slots in the rotating disc valve communicate with another arcuate slot in the fixed shoe located on the opposite side of the disc valve from the knife hub. The arcuate slot in the fixed shoe is connected to a negative pressure source and, thus, provides negative pressure to the arcuate slot in the rotating disc valve when the arcuate slot in the disc valve overrides the negative pressure arcuate slot in the fixed shoe during a period of rotation of the rotating disc valve.

The result is that axial ports in the knife hub are exposed first to vacuum when in communication with the arcuate slots in the rotating disc valve and the negative pressure arcuate slot in the fixed shoe. The axial ports transition to positive pressure when in communication with the aperture in the rotating disc valve and the positive pressure slot in the fixed shoe. Since the slots and apertures on the rotating disc are in a fixed relation to each other, a uniform and immediate transition is always made from vacuum to pressurized air applied to the suction cup, regardless of the angular position and count of pouches being discharged from the rotary knife apparatus.

More particularly, in one embodiment of the present invention, the rotary knife apparatus includes first and second negative pressure sources communicating with each of the suction cups along respective first and second segments of rotation of the knife hub. The rotating disc valve communicates with the second negative pressure source and the positive pressure source to define a preselected number of drop-off points occurring during cyclic intervals corresponding to a certain amount of rotation of the knife hub. The knife hub includes a plurality of radial ports extending inwardly from each of the suction cups whereby the negative and positive pressure sources communicate with each of the suction cups through the radial ports.

The knife hub further includes a series of axial inlet ports lying in a circle about one side of the knife hub whereby each axial inlet port communicates between a pair of radial ports corresponding to a respective pair of suction cups and the one side of the knife hub. A knife hub shoe is mounted on the side of the knife hub and includes first and second series of axial ports communicating between the first negative pressure source and the series of axial inlet ports in the knife hub. The knife hub shoe further includes third and fourth series of axial ports communicating between the second negative pressure source inlet and the positive pressure source, respectively, and the series of axial inlet ports.

The first negative pressure source of the present invention preferably comprises a vacuum reservoir mounted on one side of the rotary knife apparatus and includes a vacuum chamber in communication with the first and second series of axial ports during the first segment of rotation of the knife hub. The rotary knife apparatus further includes a vacuum shoe mounted to the vacuum reservoir and having a plurality of arcuate vacuum slots which communicate between the vacuum reservoir and the first and second series of axial ports for supplying vacuum to the suction cups along the first segment of rotation of the knife hub.

The rotary knife apparatus preferably includes a first ring having first and second arcuate slots therein. The first arcuate slot communicates between the second negative pressure source and the third series of axial ports, and the second arcuate slot communicates between the positive pressure source and the fourth series of axial ports.

In accordance with a preferred embodiment, the rotary disc valve of the present invention comprises a second ring about the vacuum shoe for slidably rotating thereon. The second ring is intermediate the first ring and the knife hub shoe and includes a series of arcuate slots for communicating between the first arcuate slot of the first ring and the third series of axial ports. The second ring further includes a series of apertures for communicating between the second arcuate slot of the first ring and the fourth series of axial ports whereby changing rotational speed of the second ring relative to the knife hub changes both the angular spacing and the predetermined number of drop-off points corresponding to the number of pouches being deposited into the product transfer buckets.

In a preferred operation of the present invention, vacuum is supplied by the first negative pressure source to the first and second axial ports of a respective pair of suction cups for grasping an overlying pouch as the first and second axial ports overlie the arcuate vacuum slots in the vacuum shoe during rotation of the knife hub, that is, the first segment. As the first and second axial ports of the respective pair of suction cups leave the vacuum slots of the vacuum shoe, vacuum is then supplied by the second negative pressure source to the third axial port of the suction cups as the third axial port overlies an arcuate slot in the rotating disc valve and the first arcuate slot of the first ring, that is, the second segment. As the third axial port leaves this overlying arrangement of the second segment, a puff of air is supplied by the positive pressure source to the fourth axial port of the respective pair of suction cups to expel the pouch from the suction cups as the fourth axial port overlies an aperture in the rotating disc valve and the second arcuate slot in the first ring.

It will be appreciated that the count of pouches being deposited from the rotary knife into the product transfer buckets can be varied as the rotational speed of the rotating disc valve is varied relative to that of the knife hub. Furthermore, the pouch distribution pattern can thus be varied to accommodate for different configurations of product transfer buckets beneath the rotary knife apparatus.

BRIEF DESCRIPTION OF THE DRAWINGS

These and other modifications and advantages will become even more readily apparent from the following detailed description of a preferred embodiment of the invention, and from the drawings in which.

DETAILED DESCRIPTION OF THE INVENTION

GENERAL ORGANIZATION OF POUCH FORM, FILL AND SEAL OPERATION

Figure 1:
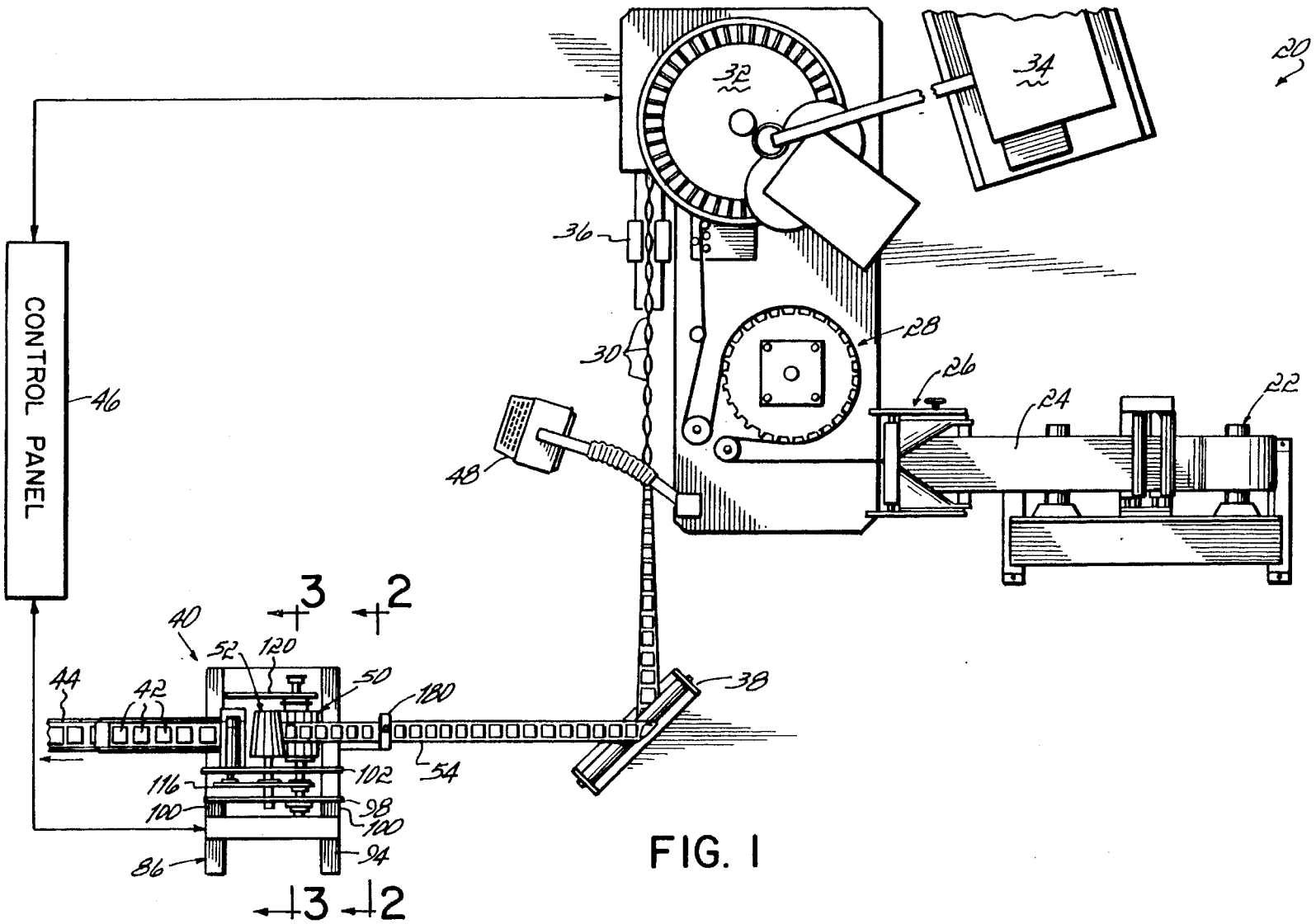
FIG. 1 is a diagrammatic plan view of a pouch form, fill and seal machine in which the present invention is used.

With reference to FIG. 1, a pouch form, fill and seal machine 20 is shown having a web supply 22 feeding a flat web 24 of heat-sealable material through plow 26 to be longitudinally folded upon itself. The thus-folded web is passed about a vertical sealer 28 having vertically extending heated sealing surfaces which contact the folded web along discrete areas to form transverse seals 30. In this way, open-ended pouches are formed along the web between the transverse seals 30 and are passed around a filler wheel 32 to be filled with product fed from a product feeding station 34. The train of filled open-ended pouches then passes through an upper edge sealer 36 which seals the pouches along respective open ends between the transverse seals 30.

In one embodiment, the web of filled and sealed pouches is rotated 90 degrees through turning bar 38 and passed through a rotary knife apparatus 40 wherein the web of pouches is cut along the transverse seals 30 into individual pouches 42. Preferably, the individual pouches 42 are deposited onto a product transfer conveyor 44 disposed beneath the rotary knife apparatus 40 for subsequent cartoning or other secondary packaging. While the details of product conveyor 44 do not constitute part of this invention, it will be appreciated that conveyor 44 may be the product conveyor of an associated cartoning machine, such that no intervening transfers, counters, or pouch stackers are required prior to cartoning the pouch stacks formed on a product conveyor by this invention.

Operation of the pouch form, fill and seal machine 20 and the rotary knife apparatus 40 is controlled via a control panel 46 which receives user commands via an operator control console 48 and which further receives and generates appropriate control signals for operation of the machine 20 and the rotary knife apparatus 40 as will be described in more detail below. It will be appreciated that the control panel 46 includes controllers understood by those skilled in the art for operation of the pouch form, fill and seal machine 20.

THE ROTARY KNIFE APPARATUS

Figure 2:
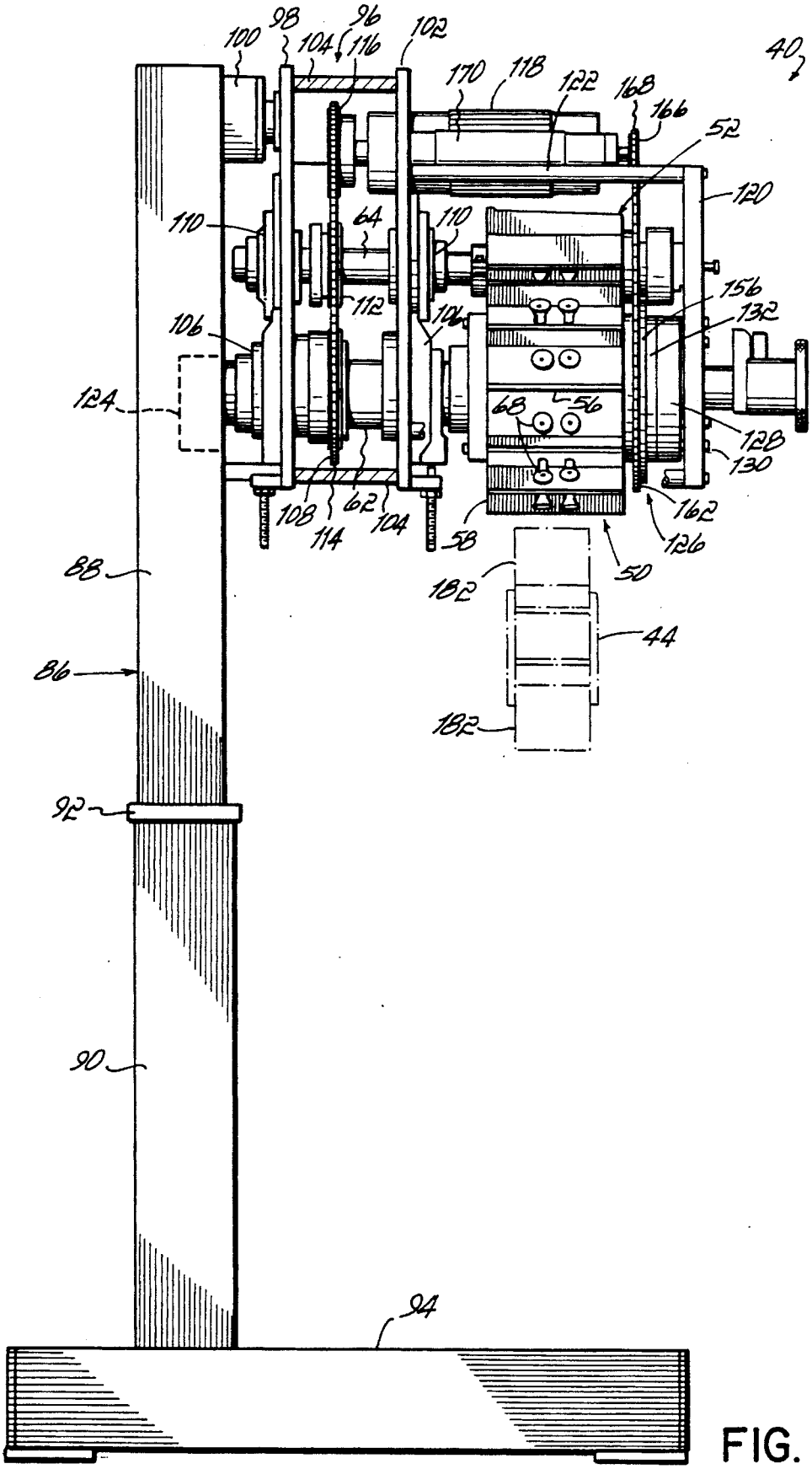
FIG. 2 is a side view of the present invention taken along view lines 2—2 of FIG. 1.
Figures 3, 3A:
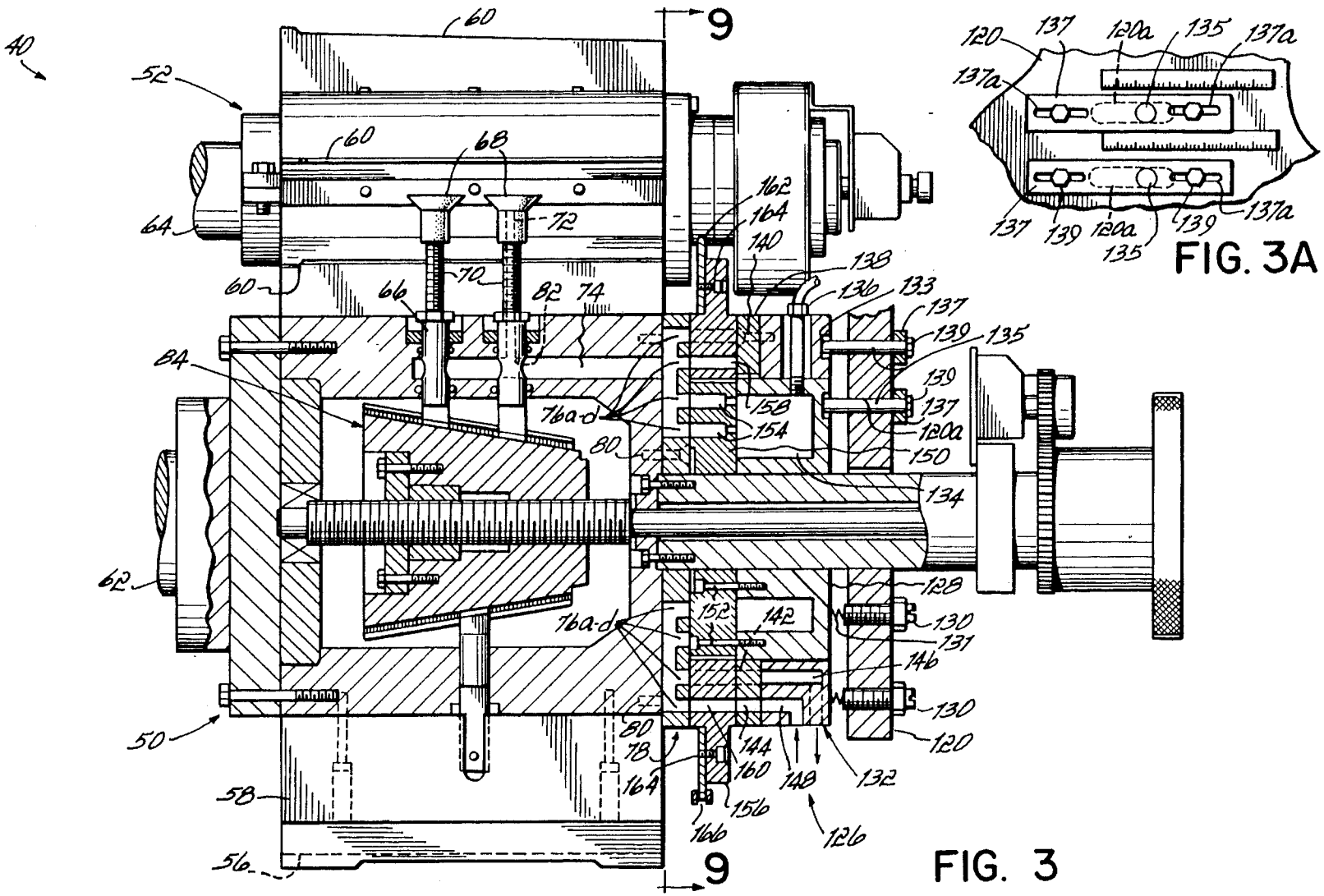
FIG. 3 is a partial cross-sectional view of the present invention taken generally along lines 3—3 of FIG. 1.
FIG. 3A is an illustrative front view of the anti-rotation pin mounting for the vacuum reservoir adjustable ring of FIG. 3.

The rotary knife apparatus 40 is the focus of the present invention and includes, as shown in FIGS. 1–3, a major knife hub 50 cooperating in shear with a minor knife hub 52 to cut the individual pouches 42 from a web 54 of filled pouches. The design and construction of the major and minor knife hubs 50 and 52, respectively, while discussed in brief herein, are clearly available from the disclosure of copending application Ser. No. 08/338,848 filed on the same date as this application, and entitled "Convertible Pitch Knife Apparatus," by P. Dieterlen (attorney docket number J&C-139) which is expressly incorporated herein by reference.

In accordance with one embodiment of the present invention, the major knife hub 50 includes a plurality of rigid knife blades 56 mounted on radially extending knife blocks 58 attached to the major knife hub 50. The rigid knife blades 56 cooperate with a plurality of tapered flexible knife blades 60 radially extending from the minor knife hub 52 for cutting the web 54 as it passes between the hubs 50 and 52. The major and minor knife hubs 50 and 52, respectively, are preferably cantilevered on respective major and minor knife hub shafts 62 and 64.

The major knife hub 50 further includes a plurality of radially extending and circumferentially spaced suction cup mounts 66, arranged in side-by-side pairs, and each terminating in a suction cup 68, mounted intermediate the radially extending and circumferentially spaced knife blades 56. The suction cups 68 are provided for grasping the individual pouches 42 in register with the suction cups 68 during defined segments of rotation of the major knife hub 50 and for expelling the pouches 42 at a predetermined number of angular drop off points in preselected count stacks along the product conveyor 44.

The suction cups 68 are mounted on threaded suction cup holders 70 which are extensions of the suction cup mounts 66 and include radial ports 72 extending inwardly from the suction cups 68 for communication with positive and negative pressure sources as will be described in more detail below. A plurality of axial inlet ports 74 are provided in the major knife hub 50 which communicate between the radial ports 72 of the suction cups 68 and a series of axial ports **76*a*–76*d* in a knife hub shoe 78 mounted on the major knife hub 50 via screws 80**.

The suction cup mounts 66 extend radially through a plurality of circumferentially spaced radial bores 82 in the major knife hub 50 and attach at one respective end to an axially movable cone 84 within the major knife hub 50. In this way, the suction cups 68 are selectively extensible and retractable in respective radial directions to adjust contact with the web 44 as it passes between knife hubs 50 and 52.

As shown in FIG. 2, the rotary knife apparatus 50 includes a support frame 86 including pairs of upper and lower support stands 88 and 90, respectively, which are fixedly adjustable relative to each other at joints 92 and secured to a base 94 for positioning the knife apparatus 40 at a desired height above the product conveyor 44. The rotary knife apparatus 40 further includes a cage 96 defined by a rear mounting plate 98 attached to the support frame 86 through vibration mounts 100 (one shown) disposed at each corner of the plate 98 and a front mounting plate 102 attached to the rear mounting plate 98 through braces 104.

The major knife hub shaft 62 is supported in bearing blocks 106 mounted outside the cage 96 and includes a double sprocket 108 fixed to the shaft 62 within the cage 96. The minor knife hub shaft 64 is supported in bearing blocks 110 mounted outside the cage 96 and includes a double sprocket 112 fixed to the shaft 64 and co-planar with the double sprocket 108. Preferably, bearing blocks 106 and 110 are preloaded tapered bearings for supporting shafts 62 and 64, respectively.

Double sprockets 108 and 112 are preferably driven by a multi-strand small pitch (3/8", for example) chain 114 which is itself driven by a driving double sprocket 116 attached to a motor 118 and co-planar with double sprockets 108 and 112. It will be appreciated that chain 114 could be replaced with a backwrapped timing belt or similar continuous driving member without departing from the present invention.

Referring to FIGS. 2 and 3, the rotary knife apparatus 40 further includes a cantilevered support plate 120 attached to the front mounting plate 102 through braces 122. The major and minor knife hubs 50 and 52, respectively, are mounted intermediate the front mounting plate 102 and the support plate 120 on respective major and minor knife hub shafts 62 and 64 which are themselves cantilevered by the cage 96. The major knife hub shaft 62 includes an encoder 124 at a remote end of the shaft from the major knife hub 50 for measuring angular displacement of the major knife hub 50 during operation of the rotary knife apparatus 40. Mounted intermediate the major knife hub 50 and the support plate 120 is a vacuum and valving system 126 which is the primary focus of the present invention.

THE VACUUM AND VALVING SYSTEM

As shown most clearly in FIG. 3, the vacuum and valving system 126 includes a vacuum reservoir 128 and an adjustable ring 132 slidably disposed about the vacuum reservoir 128. Both the vacuum reservoir 128 and the adjustable ring 132 are spring-loaded toward the major knife hub 50 by means of adjusting screws 130 containing compression springs 131. The vacuum reservoir 128 and the adjustable ring 132 are each acted upon by three such screws and springs, spaced equally about circles of appropriate diameter to provide even pressure. Furthermore, the vacuum reservoir 128 and the adjustable ring 132 each contain a radial slot 133, into which an anti-rotation pin 135 projects. The pin 135 is attached to a block 137 which is mounted over an elongated slot 120*a* in support plate 120 by screws 139. The pins 135 prevent rotation of the vacuum reservoir 128 and adjustable ring 132 during normal operation of the knife, yet also provide a means by which they may be rotated within limits for purposes of adjusting the timing of the valving system. In this regard, pins 135 are held in the blocks 137 and these blocks can be moved along slot 120*a* by virtue of slots 137*a* when the screws 139 are loosened so as to adjust the angular position of the adjusting ring 132 or reservoir 134, respectively. Vacuum is supplied to a vacuum chamber 134 within the vacuum reservoir 128 from a negative pressure source (not shown) via a vacuum tube 136 extending through a clearance hole or slot in the adjustable ring 132.

A ring 138 is fixed to the adjustable ring 132 via screws 140 and includes a pair of arcuate slots 142 and 144 which communicate with respective vacuum and air ports 146 and 148 in the adjustable ring 132 as shown diagrammatically in FIG. 3. Vacuum and air ports 146 and 148, respectively, are coupled to respective negative and positive pressure sources (not shown) whereby arcuate slot 142 provides negative pressure and arcuate slot 144 provides positive pressure to the suction cups 68 to respectively hold and expel the pouches 42 during defined segments of rotation of the major knife hub 50. It will be appreciated that the negative pressure sources supplying vacuum to the chamber 134 and port 146 may originate in the same source.

A vacuum shoe 150 is mounted on the vacuum reservoir 128 via screws 152 and includes a plurality of staggered arcuate vacuum slots 154 which overlie and communicate with the vacuum chamber 134. The arcuate vacuum slots 154 communicate with the first and second series of axial ports 76*a* and 76*b* in the knife hub shoe 78 along a segment of rotation of the knife hub 50 and are staggered so that if a pouch 42 drops off a particular pair of suction cups 68 and causes those cups to lose vacuum, that pair of cups 68 remains isolated from adjacent sets of suction cups 68.

In accordance with the present invention, a rotating disc valve 156 is provided intermediate the fixed ring 138 and the knife hub shoe 78 and includes a plurality of arcuate slots 158 and apertures 160 which communicate between the arcuate vacuum and air slots 142 and 144 in the fixed ring 138, respectively, and the third and fourth series of axial ports 76*c* and 76*d*, respectively, in the knife hub shoe 78.

The rotating disc valve 156 further includes a metal sprocket 162 fixed about an outer edge of the disc valve 156 via screws 164 whereby the rotating disc valve 156 is driven by a chain 166. The chain 166 is driven by a driving sprocket 168 attached to a servo-motor 170 as shown in FIG. 2. The servo-motor 170 is independently controllable via the control panel 46 from the motor 118 which may also be servo-controlled via the control panel 46. In this way, the rotating disc valve 156 dynamically supplies and interrupts negative and positive pressure to the suction cups 68 for selectively depositing the pouches 42 in preselected count stacks along the product transfer conveyor 34 as described in more detail below.

Figure 4:
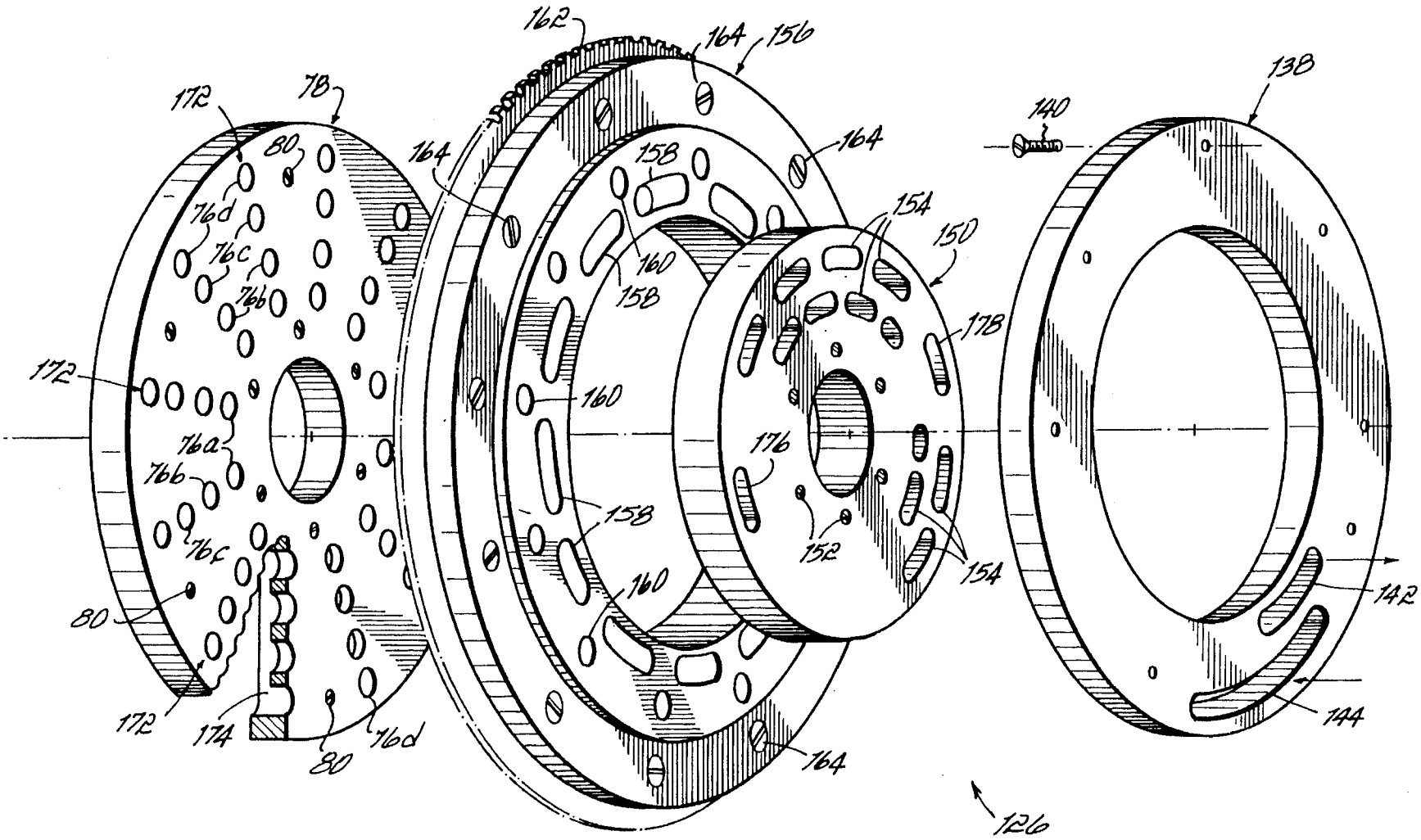
FIG. 4 is an enlarged exploded view of the valving rings and shoes of the present invention.

With reference to FIG. 4, the knife hub shoe 78, rotating disc valve 156, vacuum shoe 150 and fixed ring 138 of the vacuum and valving system 126 are shown in more detail. The axial ports 76*a*–76*d* of the knife hub shoe 78 lie in concentric circles about one side of the knife hub shoe 78 and are further aligned in a series of radially extending rows 172 wherein each of the axial ports 76*a*–76*d* in a respective row 172 are interconnected by a radially extending channel 174 on a remote side of the knife hub shoe 78 adjacent the major knife hub 50. In this way, each channel 174 in the knife hub shoe 78 overlies a respective axial inlet port 74 in the knife hub 50 such that each row 172 of axial ports 76*a*–76*d* communicates with a respective axial inlet port 74 and, thus, a respective pair of suction cups 68.

It will be appreciated that the number of rows 172 of axial ports 76*a*–76*d* coincides with the number of rigid knife blades 56 and suction cup pairs 68 mounted on the major knife hub 50. Each adjacent rigid knife blade 56 and suction cup pair 68 comprises a "knife station," with each knife blade 56 leading its respective trailing suction cup pair 68 as the knife hub 50 rotates about the shaft 62 and cuts the web 54 of filled pouches.

Figure 5A:
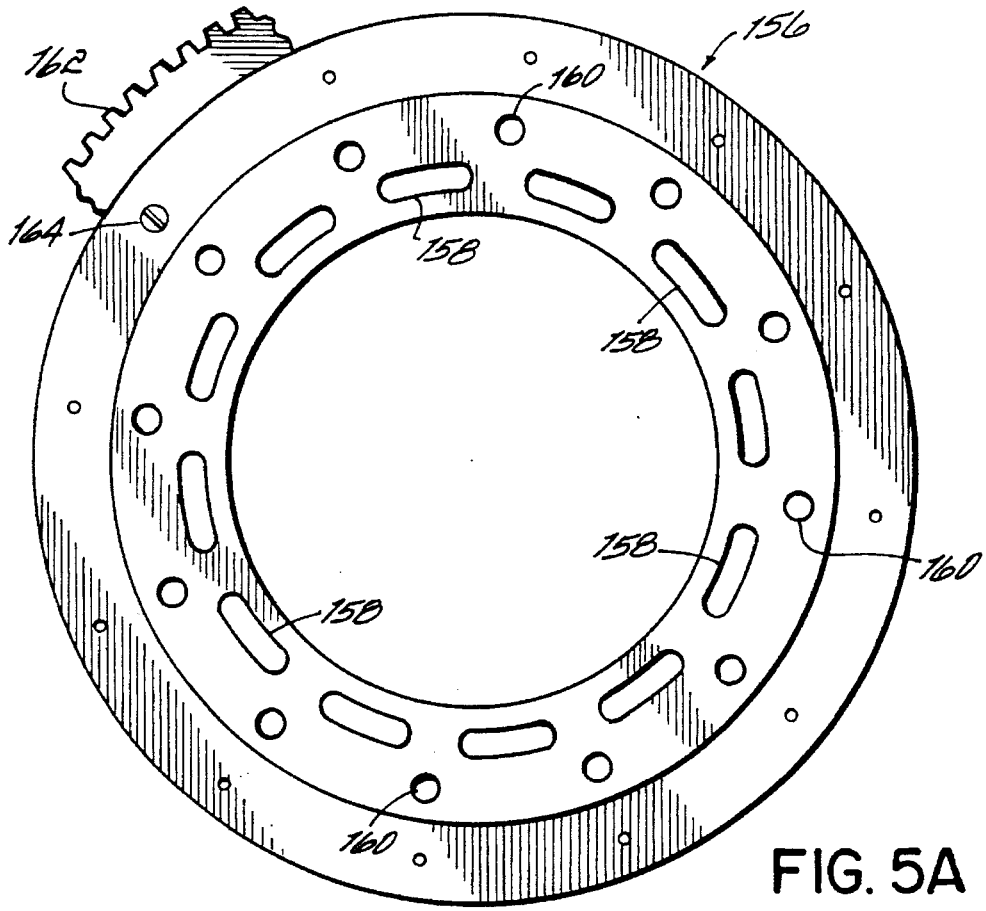
FIG. 5A is a front view, partially broken away, of one embodiment of the rotating disc valve of the present invention.

As shown in FIGS. 4 and 5A, the rotating disc valve 156 includes staggered series of concentric arcuate slots 158 and apertures 160 for communicating between the respective arcuate slots 142 and 144 of the fixed ring 138 on one side and the third and fourth series of axial ports 76*c* and 76*d* on the other side. Each adjacent aperture 160 and arcuate slot 158 comprises a "valve station", with each aperture 160 leading its respective arcuate slot 158 as the rotating disc valve 156 rotates in the same direction as the knife hub 50.

In one embodiment, the number of "valve stations" on the rotating disc valve 156, twelve being shown, equals the number of "knife stations" on the major knife hub 50, with twelve being shown. The number of "valve stations" and "knife stations" can differ, in accordance with the present invention, for purposes to be described in more detail below. Additionally, in one embodiment as shown in FIG. 5A, the apertures 160 and arcuate slots 158 are equally spaced about the rotating disc valve 156 such that, for example, a twelve "valve station" rotating disc valve 156 will have apertures 160 and arcuate slots 158 equally spaced about the disc valve 156 in 30° increments.

Figure 5B:
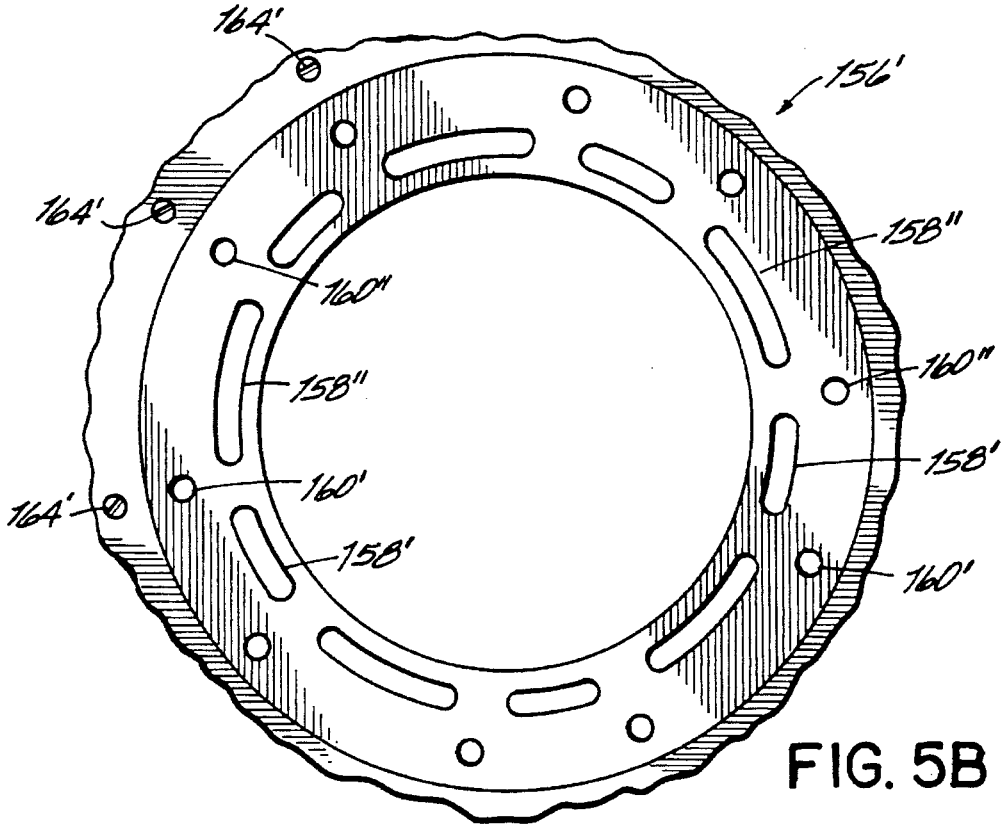
FIG. 5B is a front view, partially broken away, of a second embodiment of the rotating disc valve of the present invention.

In another embodiment as shown in FIG. 5B, the rotating disc valve 156' includes ten "valve stations" wherein adjacent "valve stations," including aperture 160' and respective arcuate slot 158' and aperture 160" and respective arcuate slot 158", are spaced at 30° and 42° increments about the disc valve 156 for purposes to be described below. Screws 164 of FIG. 5A and screws 164' of FIG. 5B are used as elements of an encoder system to indicate angular displacement of either the rotating disc valve 156 or 156', respectively, during operation of the rotary knife apparatus 40.

With further reference to FIG. 4, the vacuum shoe 150 includes the staggered slots 154 which communicate between the vacuum chamber 134 on one side and the first and second series of axial ports 76*a* and 76*b* during one segment of rotation of the knife hub 50. In one embodiment, the vacuum shoe 150 is co-planar with the rotating disc valve 156 whereby the rotating disc valve 156 slidably rotates about the vacuum shoe 150.

The vacuum shoe 150 includes an arcuate slot 176 in communication with a positive pressure source for blowing air through the radial ports 70 of the suction cups 68 to clear the radial ports 70 of foreign debris as the second series of radial ports 76*b* overlies the slot 176. The vacuum shoe 150 further includes an arcuate slot 178 in switchable communication with negative and positive pressure sources to either hold a "good" pouch or expel a "bad" pouch as determined by a β-ray detector 180 (see FIG. 1) upstream of the rotary knife apparatus 40.

As shown in FIG. 4, the fixed ring 138 includes the negative pressure arcuate slot 142 and positive pressure arcuate slot 144 communicating with the respective arcuate slots 158 and apertures 160 of the rotating disc valve 156. It will be appreciated that the arcuate length of the positive pressure slot 144 can be changed to correspondingly change an angular drop-off range for the pouches 42 as will be described below. Additionally, the fixed ring 138 can be angularly adjusted either manually or dynamically to correspondingly angularly adjust drop-off points of the pouches 42 during a period of rotation of the knife hub 50.

OPERATION

In one operation of the rotary knife apparatus 40, as shown in FIGS. 6A–6C and FIGS. 7A–7D, the knife hub shoe 78 includes twelve "knife stations" represented by twelve rows 172 of radial ports 76*a*–76*d* and the rotating disc valve 156 includes twelve "valve stations" equally spaced about the disc valve 156 at 30° increments. Pouches 42 are carried along one segment of rotation of knife hub 50 as the first and second series of axial ports 76*a* and 76*b* , respectively, in the knife hub shoe 78 override the staggered arcuate vacuum slots 154 in the vacuum shoe 150. As the third series of axial ports 76*c* override an arcuate slot 158 in the rotating disc valve and the negative pressure slot 142 in the fixed ring 138, negative pressure is continued to be supplied along another segment of rotation of the knife hub 50. It will be appreciated that the negative pressure supplied during various segments of rotation of the knife hub 50 may originate in the same negative pressure source.

Figure 6A:
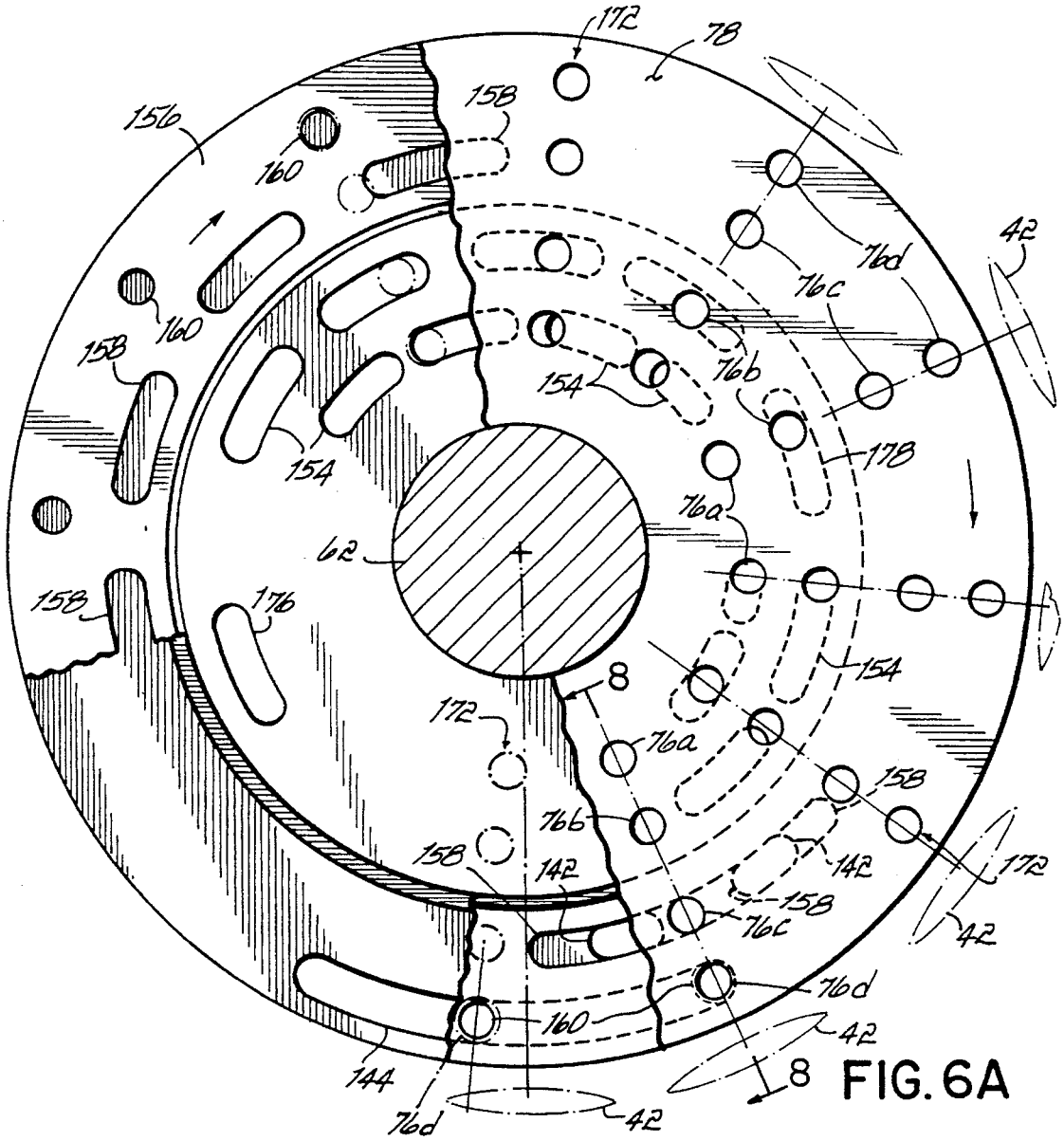
FIG. 6A is an enlarged diagrammatic view showing the interaction of the ports, slots and apertures in the vacuum shoe, fixed ring, rotating disc valve and knife hub shoe during a first and fourth pouch drop in preselected four pouch count stacks as shown in FIGS. 7A and 7D, respectively.
Figure 7A:
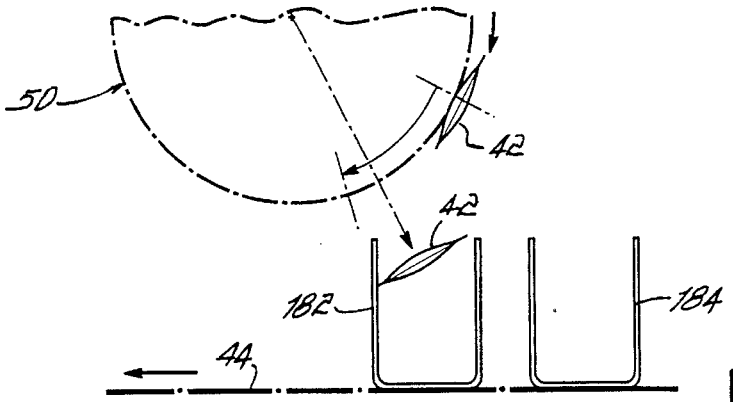
FIG. 7A to 7D are diagrammatic views of product transfer buckets receiving first, second, third and fourth pouch drops, respectively, in preselected four pouch count stacks.
Figure 7B:
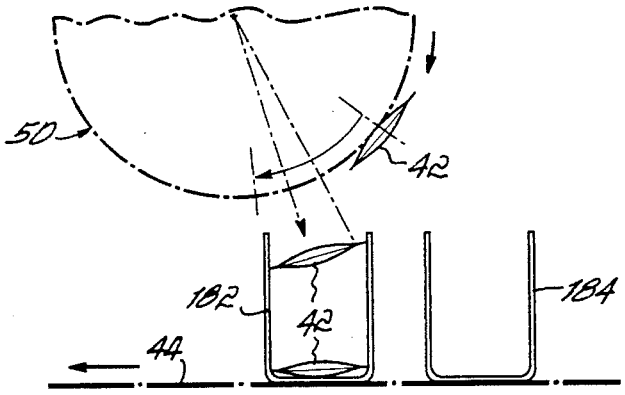
Figure 7C:
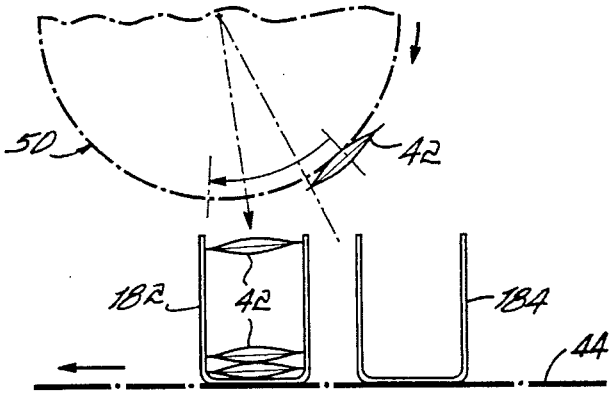

As shown in FIGS. 6A and 7A, a first pouch 42 of a four pouch drop-pattern is being dropped in a travelling bucket 182 as a fourth series axial port 76*d* in the knife hub shoe 78 overtakes a pressurized aperture 160 in the rotating disc valve 156 by virtue of positive pressure being communicated from the positive pressure slot 144 in the fixed ring 138 to the aperture 160. As the fourth series axial port 76*d* overtakes the pressurized aperture 160, a resulting puff of air expels the pouch 42 from the knife hub 50 and into the travelling bucket 182. Negative pressure has been interrupted as first and second series axial ports 76*a* and 76*b* have transitioned from the arcuate vacuum slots 154 and the third series axial port 76*c* in the same row 172 has transitioned from an overriding relationship with an arcuate slot 158 in the rotating disc valve 156 and the negative pressure slot 142 in the fixed ring 138.

Figure 8:
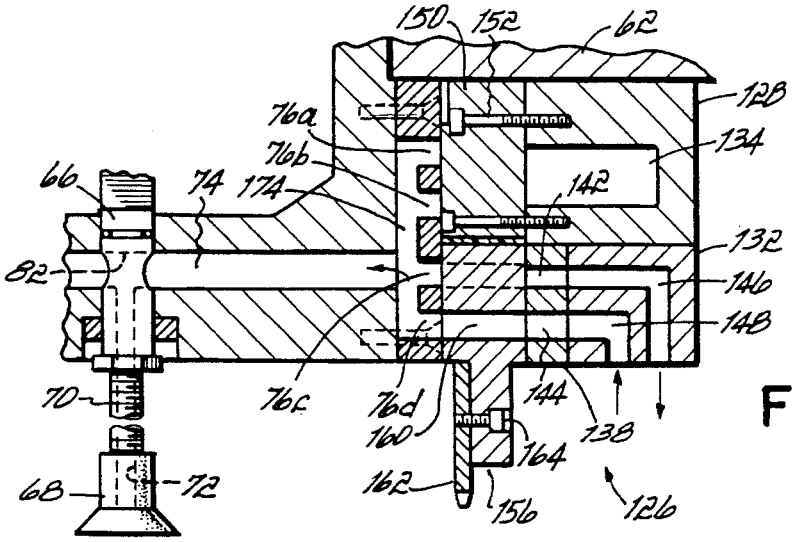
FIG. 8 is a partial cross-sectional view taken along line 8—8 of FIG. 6 and showing the application of positive pressure to the respective pair of suction cups in the knife hub via the porting arrangement of the fixed ring, rotating disc valve and knife hub shoe to expel the pouch as the suction cups and rotating disc valve pass this position shown in FIG. 6.
Figure 6B:
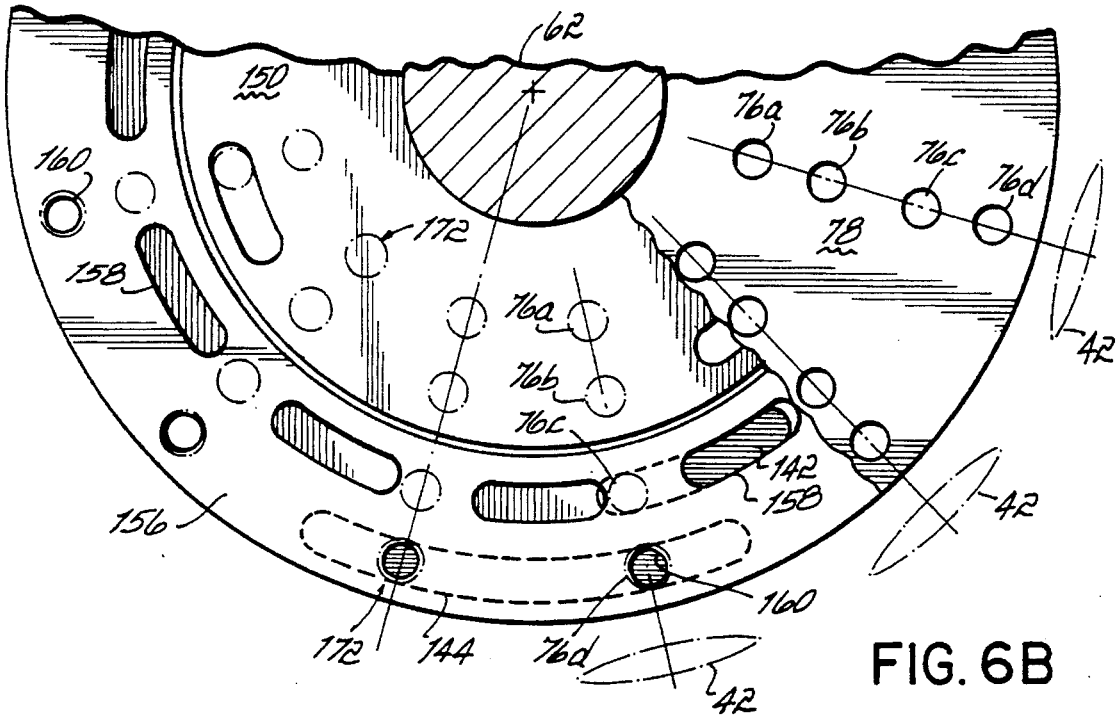
FIG. 6B is a figure similar to FIG. 6A showing a second pouch drop in a preselected four pouch count stack as shown in FIG. 7B.
Figure 6C:
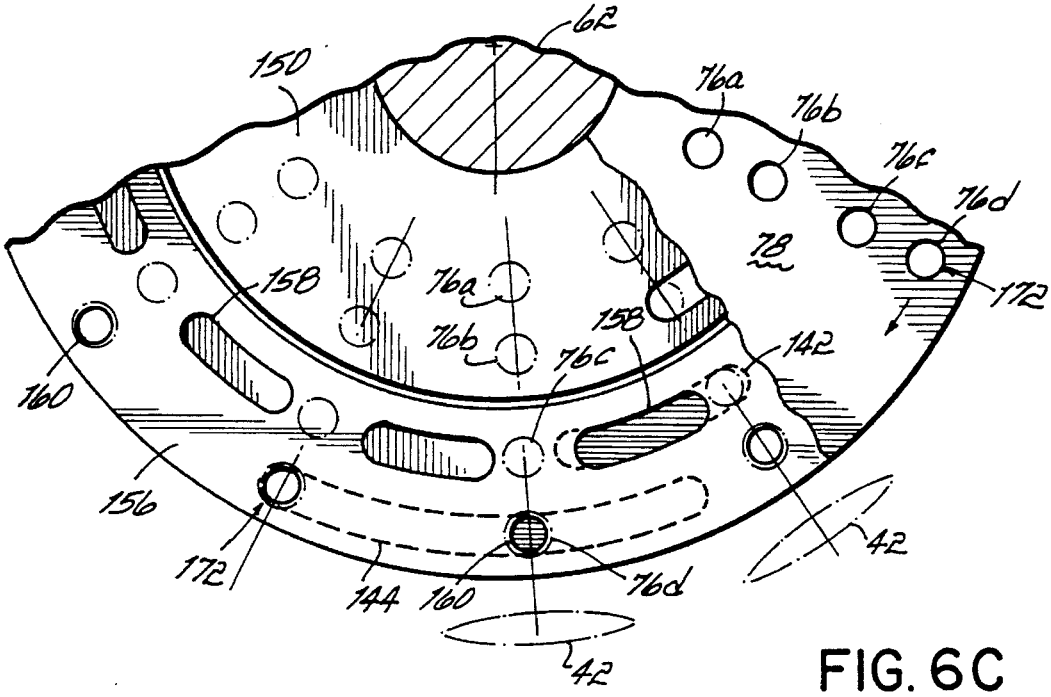
FIG. 6C is a figure similar to FIG. 6B showing a third pouch drop in a preselected four pouch count stack as shown in FIGS. 7C.

With reference to FIG. 8, a preselected pouch drop position is shown as positive pressure is being supplied to the suction cup pair 68 (one shown) via positive pressure communicating from the air port 148 in the adjustable ring 132 to the positive pressure slot 144 in the ring 138 which is fixed to ring 132. A fourth series radial port 76*d* has overtaken a pressurized aperture 160 in the rotating disc valve 156 by virtue of the positive pressure being communicated from the positive pressure slot 144 in the fixed ring 138 to the aperture 160. As the fourth series radial port 76*d* overrides the pressurized aperture 160, a brief puff of air is communicated from the fourth series radial port 76*d* to the pair of suction cups 68 (one shown) via the axial inlet port 74 and the radial ports 70 (one shown). Negative pressure from the negative pressure source to a third series axial port 76*c* is interrupted by interposition of the rotating disc valve 156.

In similar fashion, as shown in FIGS. 6B–6C and 7B–7C, second and third pouches 42 of a four pouch drop-pattern are being dropped in a travelling bucket 182 as fourth series axial ports 76*d* in knife hub shoe 78 sequentially overtake the same pressurized aperture 160 in the rotating disc valve 156 by virtue of the positive pressure being communicated from the positive pressure slot 144 in the fixed ring 138 to the apertures 160. Negative pressure has been interrupted as first and second series axial ports 76*a* and 76*b* have transitioned from the arcuate vacuum slots 154 and third series axial ports 76*c* in the same rows 172 have transitioned from an overriding relationship with an arcuate slot 158 in the rotating disc valve 156 and the negative pressure slot 142 in the fixed ring 138.

It will be understood that the product conveyor 44 travels in a timed relationship with the knife hub 50 to receive the preselected count stack of pouches 42 in the buckets 182 along the product conveyor 44, or any other suitable form of product conveyor which might be used. Such conveyor does not constitute part of this invention.

Figure 7D:
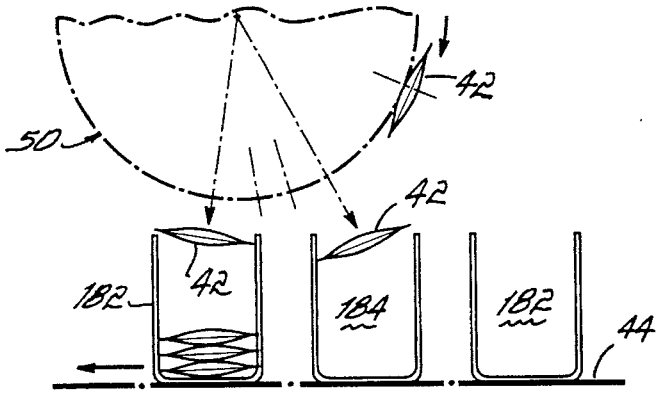

Lastly, with reference to FIGS. 6A and 7D, a fourth pouch drop in bucket 182 and a first pouch drop in a trailing bucket 184 occur simultaneously as one fourth series axial port 76*d* overtakes a pressurized aperture 160 in the rotating disc valve 156 as a new pressured aperture 160 is overtaken by another fourth series axial port 76*d*.

While FIGS. 6A–6C and 7A–7D have been shown and described as having the rotating disc valve 156 and product conveyor 44 travelling in a same direction as the rotary knife hub 50, the present invention also provides the ability to have the rotating disc valve 156 and the product conveyor 44 operated in an opposite direction as the rotary knife hub 50. In this case, the pouches 42 "back up" into the buckets 182 and 184 as will be appreciated by those skilled in the art.

In general operation of the rotary knife apparatus 40, the angular spacing and number of pouch drop-off points is determined, at least partially, by the rotational speed of the rotary disc valve 156 relative to the rotational speed of the major knife hub 50. Specifically, $$C=\left(\frac{\omega_k}{\omega_v}\right)\left(\frac{N_k}{N_v}\right)$$

where C = pouch count per stack; $\omega_k$=rotational speed of the knife hub 50; $\omega_v$=rotational speed of the rotating disc valve 156; $N_k$=number of "knife stations" on the knife hub 50; and $N_v$= number of "valve stations" on the rotating disc valve 156.

It will be appreciated from the above equation that the pouch count per stack ("C") is solely a function of the rotational speed of the rotating disc valve 156 ("$\omega_v$") relative to the rotational speed of the knife hub 50 ("$\omega_K$") when $N_k$=$N_v$.

When the knife hub 50 and rotating disc valve 156 are rotating in the same direction, a pouch drop-off range is generally defined by $$R=360°\left(\frac{1}{N_k}+\frac{\left(\frac{1}{N_v}-\frac{1}{N_k}\right)}{\left(1-\frac{N_k}{N_vC}\right)}\right)$$

where R = pouch drop-off range between first and last pouches 42 deposited in a preselected count stack.

The angular displacement between adjacent drop-off points is thus defined as $$r=\frac{R}{C-1}$$

where r = incremental angular displacement between adjacent drop-off points during a period of rotation of the knife hub 50. For example, where the pouch drop-off range between first and last pouches 42 =R and that is 36° , and where the pouch count is 4 , "r"=12°.

In this way, pouches 42 can be deposited in preselected count stacks along the product conveyor 44, and the angular spacing and number of pouch drop-off points, i.e., the pouch distribution pattern, can be dynamically changed by changing "$\omega_k$" relative to "$\omega_v$". Furthermore, the pouch distribution pattern can be changed by changing either $N_v$ or $N_k$, or both, to achieve the desired discharge pattern.

In certain pouch form, fill and seal operations, it is necessary to drop pouches 42 into dual compartment buckets 186 separated by a gap as shown in FIGS. 10A–10D to match cartoning operations. In one embodiment, the required pouch distribution pattern is achieved by the rotating disc valve 156', as shown in FIG. 5B, in connection with the vacuum and valving system 126.

The rotating disc valve 156' includes "valving stations" alternately spaced between 30° and 42° about the rotating disc valve 156'. When the 30° "valving station" is controlling the drop, adjacent buckets are filled. When the 42° "valving station" is controlling the drop, the drop pattern is extended across the gap, due to an increase in the angular range through which the group of pouches is sequentially discharged from the knife. If $N_v$ =$N_k$, then the rotational speed of the rotating disc valve 156' for the 30° section, for a preselected count of pouches, is $$30° \text{ section: } \omega_v=\frac{\omega_k}{C}$$

In this embodiment, the rotating disc valve 156' and buckets 186 must run at different speeds during the 30° and 42° increments such that the same preselected count of pouches goes into each bucket 186. Accordingly, the rotational speed of the rotating disc valve 156' must be increased during the 42° increment as $$42° \text{ section: } \omega_v=\frac{42}{30}\left(\frac{\omega_k}{C}\right)$$

In this way, a preselected count stack of pouches is deposited in each bucket 186 by appropriately controlling the rotating disc valve 156' and the product conveyor 44.

Figure 9A:
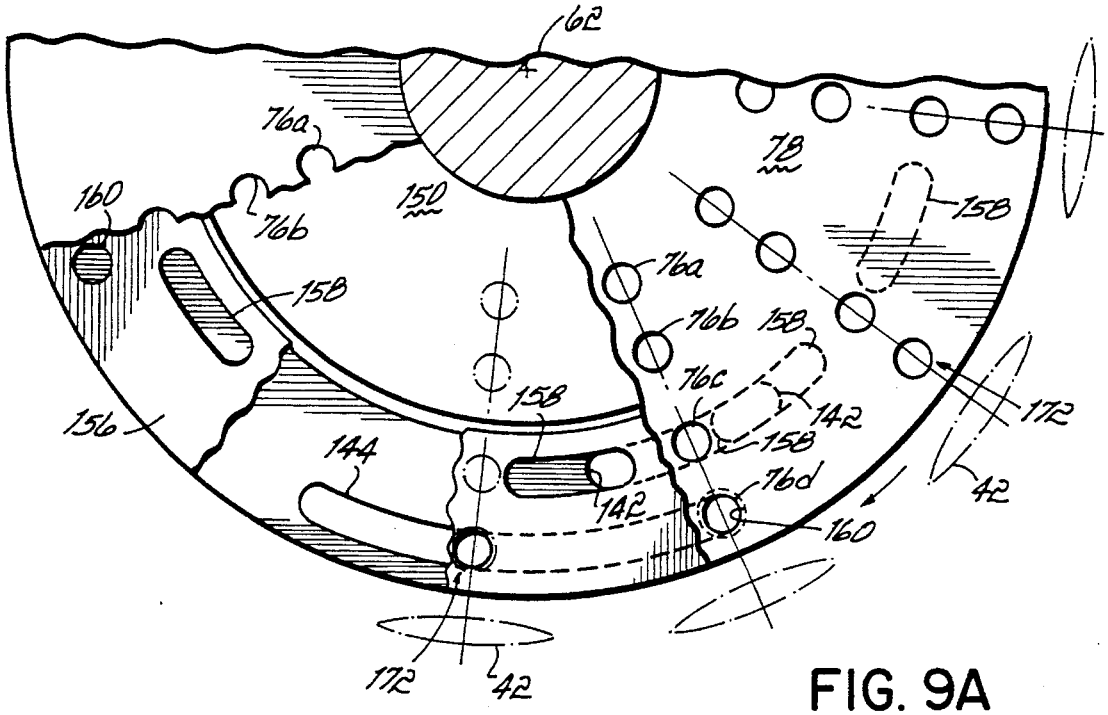
FIGS. 9A to 9D are enlarged diagrammatic views showing the interaction of the ports, slots and apertures in the vacuum shoe, fixed ring, rotating disc valve and knife hub shoe during first, second, third and fourth pairs of pouch drops in preselected four pouch count stacks as shown in FIGS. 10A to 10D, respectively.
Figure 9B:
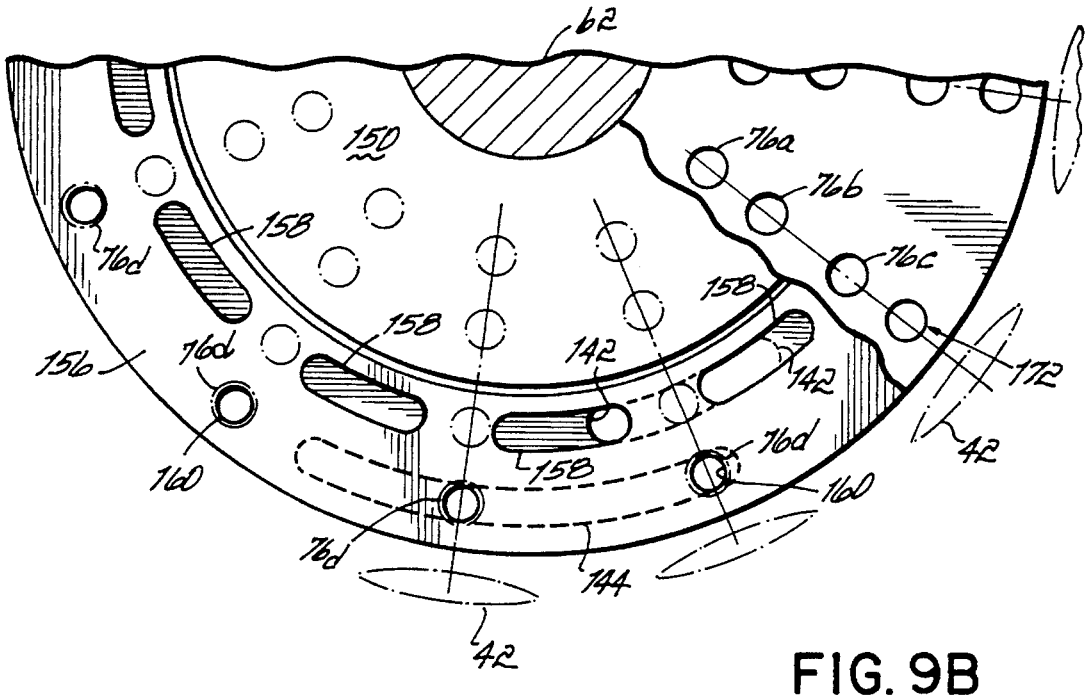
Figure 9C:
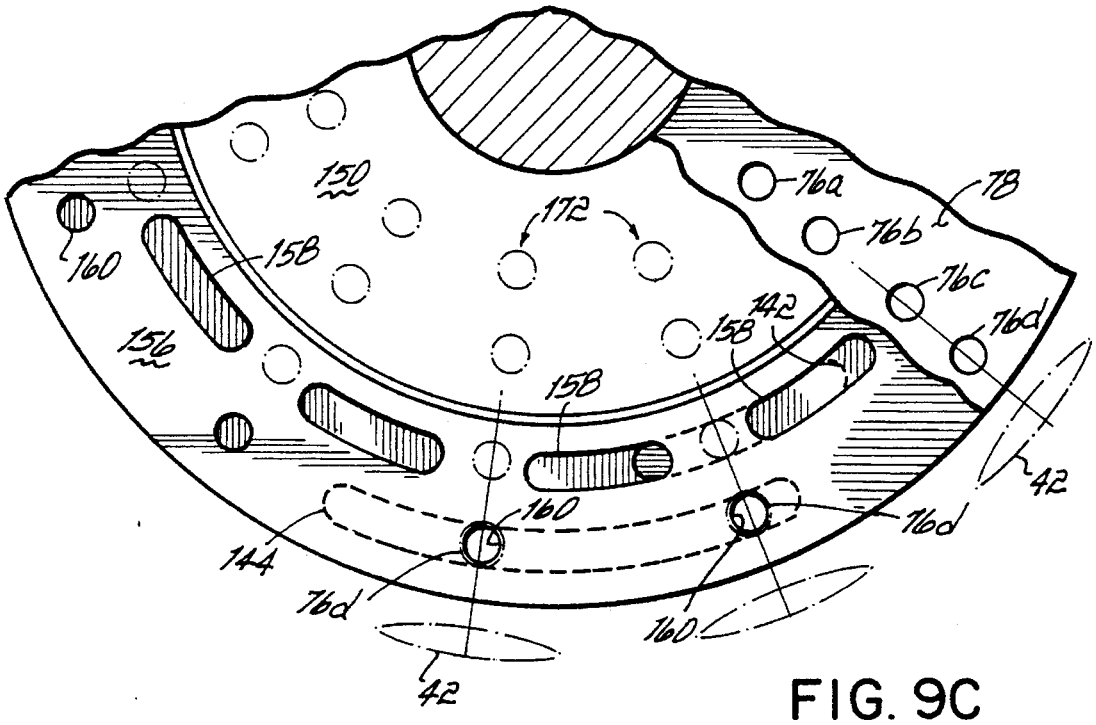
Figure 9D:
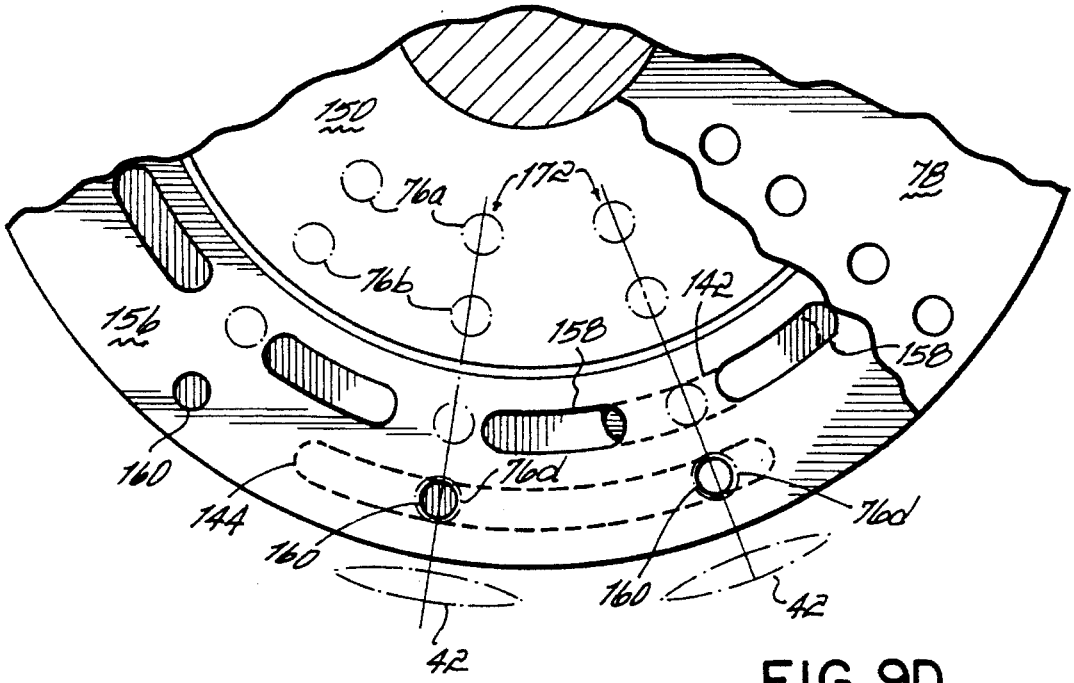
Figure 10A:
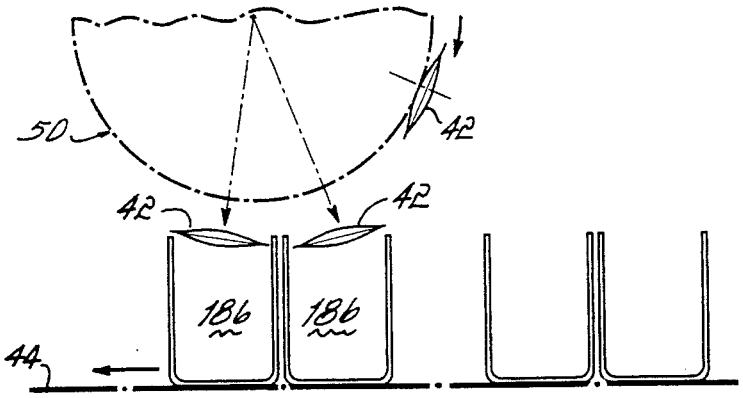
FIGS. 10A to 10D are diagrammatic views of product transfer buckets receiving first, second, third and fourth pairs of pouch drops, respectively, in preselected four pouch count stacks.
Figure 10B:
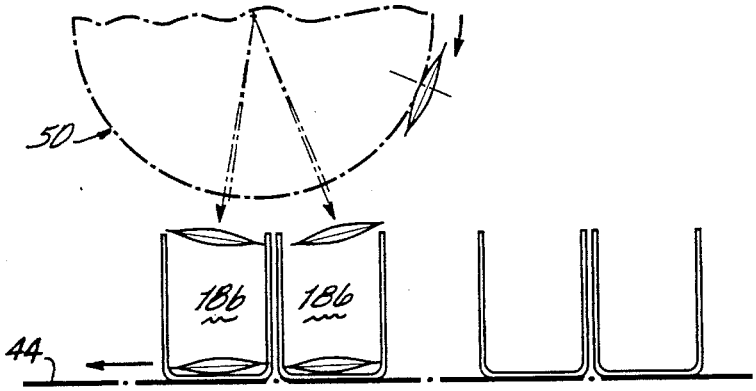
Figure 10C:
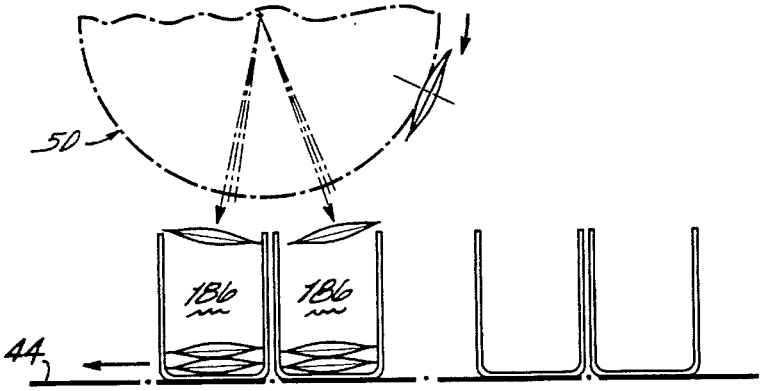
Figure 10D:
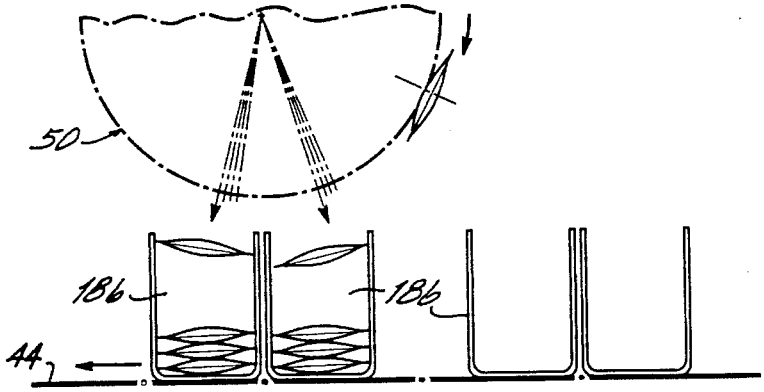

An alternative method for achieving the same result is shown in FIGS. 9A–9D and FIGS. 10A–10D. In this embodiment, progressive pairs of pouches 42 are simultaneously deposited in the dual compartment buckets 186 in preseleoted count stacks. With reference to FIG. 9A and FIG. 10A, a first pair of pouches 42 is simultaneously deposited into the dual compartment buckets 186 as respective fourth series axial ports **76*d* simultaneously reach and overtake respective pressurized apertures 160 in the rotating disc valve 186. Negative pressure is interrupted at these discharge points as respective third series axial ports 76*c* have transitioned from an overriding relationship with the respective arcuate slots 158 in the rotating disc valve 156 and the negative pressure slot 142 in the fixed ring 138**.

In similar fashion, and with reference to FIGS. 9B–9D and FIGS. 10B–10D, second, third and fourth pairs of pouches 42 are simultaneously dropped into dual compartment buckets 186 to achieve the preselected four pouch count stack. As the knife hub 50 rotates at a faster rotational speed than that of the rotating disc valve 156, progressive pairs of fourth series axial ports **76*d* reach and overtake respective pairs of pressurized apertures 160 in the rotating disc valve 156. It will be appreciated by those skilled in the art that an identical pouch distribution pattern can be achieved by rotating the rotating disc valve 156 at a faster rotational speed than that of the knife hub 50**.

Based on the foregoing description, it will be appreciated that the vacuum and valving system 126 of the present invention provides the ability to sequentially discharge pouches 42 either singly or in pairs from the rotary knife apparatus 40 and into preselected pouch count stacks along a product conveyor. The angular spacing and number of pouch drop-off points is furthermore dynamically variable as the rotational speed of the rotating disc valve 156 is varied relative to that of the knife hub 50. Moreover, the rotating knife apparatus 50 is capable of dynamically changing drop-off patterns of pouches 42 to accommodate for different configurations of product conveyors 44 beneath the apparatus 50. This results in a versatility of pouch distribution patterns and control of pouch stacks heretofore not obtainable in the prior art.

From the above disclosure of the general principles of the present invention and the preceding detailed description of a preferred embodiment, those skilled in the art will readily comprehend the various modifications to which the present invention is susceptible without departing from the scope of the present invention. Therefore, we desire to be limited only by the scope of the following claims and equivalents thereof,

What is claimed is:

1. A rotary knife apparatus for directly depositing filled pouches in preselected count stacks along a travelling product conveyor, comprising:

a rotating knife hub operably driven at a first rotational speed by a first driving element;

a product conveyor disposed beneath said knife hub;

a series of suction cups circumferentially spaced and extending radially from said knife hub, said suction cups being carried in a circular path by said knife hub;

at least one negative pressure source communicating with each of said suction cups along at least one segment of said circular path whereby said suction cups grasp a pouch in register with said suction cups during said at least one segment;

a positive pressure source communicating with each of said suction cups to propel said pouches off of said suction cups and onto said product conveyor at a predetermined number of different angular drop-off points along a segment of said circular path, said product conveyor being operable to receive said pouches in stacks of a preselected count corresponding to said number of angular drop-off points; and a rotating disc valve operably driven at a second rotational speed by a second driving element, said rotating disc valve being mounted intermediate said negative and positive pressure sources and said rotating knife hub to communicate said negative and positive pressure sources to said suction cups, said predetermined number of different angular drop-off points and said corresponding number of pouches being deposited onto said product conveyor in said preselected count stacks being operatively determined by one of said first and second rotational speeds relative to the other.

2. The apparatus of claim 1 wherein said predetermined number of different angular drop-off points and said corresponding number of pouches being deposited onto said product conveyor in said preselected count stacks are changed by changing one of said first and second rotational speeds relative to the other.

3. The apparatus of claim 1 wherein said apparatus comprises first and second negative pressure sources, said first and second negative pressure sources communicating with each of said suction cups along respective first and second segments of said circular path so that each of said suction cups grasps a pouch overlying said suction cups during said first and second segments.

4. The apparatus of claim 1 wherein said product conveyor comprises a series of product transfer buckets adapted to receive said pouches deposited from said rotating knife hub.

5. A rotary knife apparatus for directly depositing filled pouches in preselected count stacks along a travelling product conveyor, comprising:

a rotating knife hub driven by a first driving element and having a series of suction cups circumferentially spaced and radially extending from said knife hub, said suction cups being carried in a circular path by said knife hub, said knife hub further having a series of axial ports communicating with said suction cups;

a product conveyor disposed beneath said knife hub;

at least one negative and positive pressure shoe cooperating with said knife hub;

at least one pressure source for operationally conveying negative and positive pressure to said at least one negative and positive pressure shoe; and rotating disc valve driven by a second driving element and being mounted intermediate said knife hub and said at least one negative and positive pressure shoe, said rotating disc valve being operable to communicate said at least one pressure source with said axial ports of said knife hub proximate a predetermined number of different angular drop-off points, said rotating disc valve having a rotational speed which is variable relative to a rotational speed of said knife hub for changing said predetermined number of different angular drop-off points during a period of rotation of said knife hub.

6. A rotary knife apparatus for directly depositing filled pouches in preselected count stacks along a travelling product conveyor, comprising:

a knife hub being driven by a first motor;

a product conveyor disposed beneath said knife hub;

a series of suction cups circumferentially spaced and radially extending from said knife hub, said suction cups being carried in a circular path by said knife hub;

first and second negative pressure sources communicating with each of said suction cups along respective first and second segments of said circular path so that each of said suction cups grasps a pouch overlying said suction head during said first and second segments;

a positive pressure source communicating with each of said suction cups to propel said pouches off of said respective suction cups and onto said product conveyor at a predetermined number of different angular drop-off points along a segment of said circular path, said product conveyor being operable to receive said pouches in stacks of a preselected count corresponding to said number of angular drop-off points; and a rotating disc valve operable to communicate said second negative pressure source and said positive pressure source with each of said suction cups and further being driven by a second motor whereby changing a rotational speed of said rotating disc valve relative to a rotational speed of said knife hub changes both said predetermined number of different angular drop-off points and said corresponding number of pouches being deposited onto said product conveyor in said preselected count stacks.

7. The apparatus of claim 6 wherein said knife hub further includes a plurality of radial ports, each of said suction cups having a radial port extending inwardly from said suction cups whereby both said negative and positive pressure sources are communicated to said suction cups through said radial ports.

8. The apparatus of claim 7 wherein the said knife hub further includes a series of axial inlet ports about one side of said knife hub, each of said axial inlet ports communicating between at least one of said radial ports and said one side of said knife hub.

9. The apparatus of claim 8 wherein said knife hub further includes a knife hub shoe mounted to said one side of said knife hub, said knife hub shoe comprising:

first and second series of axial ports communicating between said first negative pressure source and said series of axial inlet ports;

a third series of axial ports communicating between said second negative pressure source and said series of axial inlet ports; and a fourth series of axial ports communicating between said positive pressure source and said series of axial inlet ports.

10. The apparatus of claim 9 wherein said first negative pressure source comprises a vacuum reservoir mounted on one side of said apparatus and having a vacuum chamber in communication with said first and second series of axial ports during said first segment of said circular path.

11. The apparatus of claim 10 further comprising a vacuum shoe rigidly mounted to said vacuum reservoir, said vacuum shoe bearing against said knife hub shoe and having a series of vacuum slots in communication with said vacuum chamber along said first segment of said circular path for supplying vacuum to said suction cups as said first and second series of axial ports rotate along said first segment.

12. The apparatus of claim 11 further comprising a first ring having first and second arcuate slots therein, said first arcuate slot communicating between said second negative pressure source and said third series of axial ports and said second arcuate slot communicating between said positive pressure source and said fourth series of axial ports.

13. The apparatus of claim 12 wherein said rotating disc valve comprises a second ring about said vacuum shoe for slidably rotating thereon, said second ring being intermediate said first ring and said knife hub shoe and having a series of slots communicating between said first arcuate slot of said first ring and said third series of axial ports, said second ring further having a series of apertures communicating between said second arcuate slot of said first ring and said fourth series of axial ports whereby changing rotational speed of said second ring relative to said knife hub changes both said predetermined number of angular drop-off points and said corresponding number of pouches being deposited onto said product conveyor.

14. The apparatus of claim 13 wherein said second ring is driven by a continuous chain via said second motor.

15. The apparatus of claim 14 wherein said first ring is angularly adjustable to correspondingly angularly adjust said different drop-off points.

* * * * *

UNITED STATES PATENT AND TRADEMARK OFFICE

CERTIFICATE OF CORRECTION

PATENT NO. : 5,575,187

DATED : Noveber 19, 1996

INVENTOR(S) : Paul E. Dieterlen

It is certified that error appears in the above-indentified patent and that said Letters Patent is hereby corrected as shown below:

Column 14, line 20, after "disc valve", delete "186", and insert therefor --156--.

Column 15, line 57, before "rotating disc", insert --a--.

Signed and Sealed this

Sixteenth Day of September, 1997

*Attest:*

*Attesting Officer*

BRUCE LEHMAN

*Commissioner of Patents and Trademarks*